US005832340A

United States Patent [19]

Kosagi et al.

[11] Patent Number: 5,832,340

[45] Date of Patent: Nov. 3, 1998

[54] IMAGE FORMING APPARATUS

[75] Inventors: Yoshifumi Kosagi, Toyokawa; Kenichi Wantanabe, Shinshiro, both of Japan

[73] Assignee: Minolta Co., Ltd., Osaka, Japan

[21] Appl. No.: 832,158

[22] Filed: Apr. 2, 1997

[30] Foreign Application Priority Data

Apr. 9, 1996 [JP] Japan ..... 8-086587

[51] Int. Cl.[6] ..... G03G 15/00

[52] U.S. Cl. ..... 399/88; 399/50; 399/66; 399/67

[58] Field of Search ..... 399/36, 37, 50, 399/66, 67, 70, 88, 89, 90, 174, 176, 318, 328

[56] References Cited

U.S. PATENT DOCUMENTS

| | | | |
|---|---|---|---|
| 4,090,787 | 5/1978 | Hubbard et al. . | |
| 4,474,454 | 10/1984 | Sugiura . | |
| 4,615,609 | 10/1986 | Honma . | |
| 4,627,714 | 12/1986 | Nozaki | 399/70 |
| 4,870,526 | 9/1989 | Maruta et al. . | |
| 4,882,604 | 11/1989 | Kato et al. | 399/88 |
| 5,241,343 | 8/1993 | Nishio | 399/90 |
| 5,457,516 | 10/1995 | Kim | 399/37 |
| 5,459,553 | 10/1995 | Kim . | |
| 5,670,832 | 9/1997 | Takeda | 399/37 X |

FOREIGN PATENT DOCUMENTS

| | | |
|---|---|---|
| 5-241473 | 9/1993 | Japan . |
| 6-30000 | 4/1994 | Japan . |

*Primary Examiner*—Sandra L. Brase
*Attorney, Agent, or Firm*—Burns, Doane, Swecker & Mathis, LLP

[57] ABSTRACT

In an image forming apparatus having an auto power-off function, the durability of a roller of a heat fusing member or the like is improved. Before a lapse of a specified time Δt from a time T at which an auto power-off timer stops time counting, a fusing roller is driven for the time Δt. By this operation, the fusing roller is consistently driven within the set time of the auto power-off timer, thereby reducing a continuous stress in a nip portion of the fusing roller.

33 Claims, 5 Drawing Sheets

IMAGE FORMING APPARATUS

BACKGROUND OF THE INVENTION

1. Field of the Invention

The present invention relates to an image forming apparatus, and in particular, to an image forming apparatus having a pair of rollers which rotate while in contact with each other.

2. Description of the Related Art(s)

Conventionally, in the field of a heat fusing unit, or a pair of rollers which rotate while in contact and are used in an image forming apparatus, there has been proposed a technique for rotating a pair of heating rollers of a heat fusing unit for a specified time (about 0.1 second) when a specified time has elapsed without performing image processing in a standby state as disclosed in, for example, Japanese Laid-Open Patent Application No. Hei 5-241473.

This is intended for reducing a continuous stress of heat and pressure at a nip portion of an elastic roller (equally called the shift roller), preventing the possible deformation (permanent distortion) of the nip portion due to heat and pressure and prolonging the operating life of the elastic roller.

Now, for the purpose of providing a copying machine which conforms to, for example, the International Energy Star Program for promoting energy efficiency or a similar purpose, it is sometimes the case where a copying machine having a heat fusing unit is provided with an auto power-off function.

The auto power-off is the function for turning off the main power of the copying machine or putting the copying machine into a second standby state in which the consumption power is less than that of the normal standby state when the copying machine is kept unoperated for a specified time. Since no power is supplied to the drive system of the copying machine that is automatically turned off, the copying machine does not operate.

In this case, when a set time of an auto power-off timer is shorter than a specified time required for rotating the heating roller pair in a standby stage, no rotational control of the heating roller pair is performed in the standby stage. This is, for example, the case where the set time of the auto power-off timer is not longer than two hours when a rotational control of the heating roller is executed for 0.1 second after a lapse of two hours after the stop of the operation of the apparatus. In such a case, the continuous stress in the nip portion cannot be reduced. Consequently, the durability of the elastic roller is reduced.

SUMMARY OF THE INVENTION

It is an object of the present invention to provide an improved image forming apparatus.

In order to achieve the object, the image forming apparatus of the present invention is provided with an auto power-off circuit for executing auto power-off of the apparatus after counting a specified time and a rotating section for rotating the roller before the auto power-off based on a timing at which the auto power-off is executed.

It is a further object of the present invention to improve the durability of a heat fusing member in a heat fusing unit having an auto power-off function.

In order to achieve the object, the heat fusing unit of the present invention is provided with a heat fusing member including at least one roller having an elastic layer, a heater for heating the heat fusing member, a drive control circuit for drive-controlling the heat fusing member, an auto power-off circuit for executing auto power-off of the apparatus after counting a specified time and a rotating section for rotating the roller before the auto power-off based on a timing at which the auto power-off is executed.

According to the present invention, the roller is rotated before the auto power-off is executed based on the timing at which the auto power-off is executed. With this arrangement, the continuous stress of the roller can be reduced, thereby allowing the durability of the roller to be increased.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
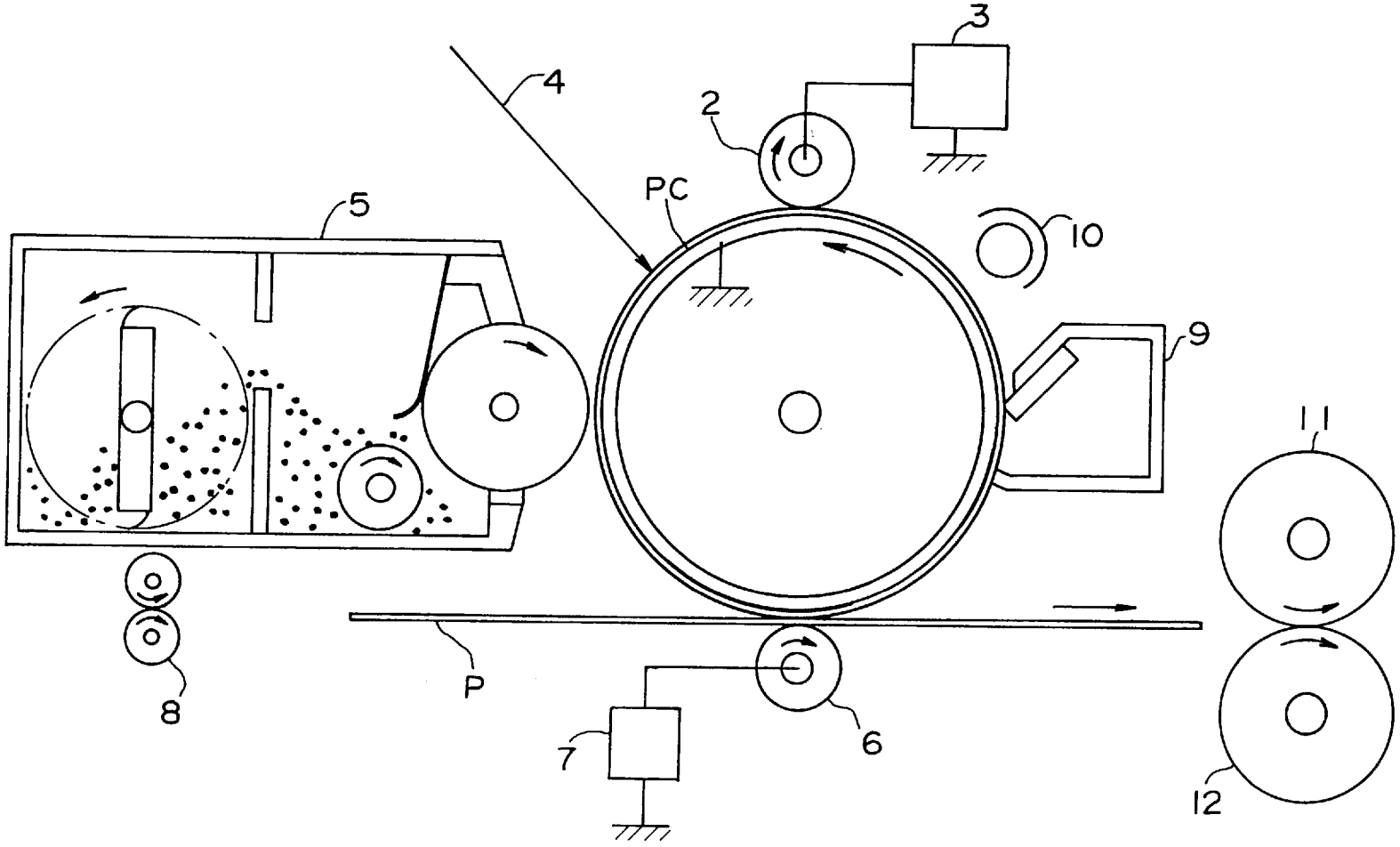
FIG. 1 is a view showing an outline construction of an image forming apparatus of the present invention.

An example of the image forming apparatus to which the present invention is applied is shown in FIG. 1. In a photoreceptor drum PC shown in FIG. 1, a photosensitive layer is formed on a conductive base, and the drum is rotated in a direction indicated by an arrow in the figure.

A charging roller 2, or a charging member, is provided on the surface of the photoreceptor drum PC in contact with it and rotated by a motor 15 described later in the direction indicated by the arrow in the figure. Then, by applying a specified charging voltage to the charging roller 2 by a power supply 3, the surface of the photoreceptor drum PC is charged in a specified polarity and to a specified surface potential. An electrostatic latent image is formed by image exposure 4 on the surface of the photoreceptor drum PC charged to the specified electric potential, and this electrostatic latent image is developed by a non-magnetic single-component developer 5 for the formation of a toner image.

In a transfer roller 6, or a transfer member, a conductive elastic layer is formed around the peripheral surface of a core metal, and the roller is rotated by the motor 15 described later in the direction indicated by the arrow in the figure as pressed against the photoreceptor drum PC with a specified pressure. Further, to the transfer roller 6 is applied a bias inverse in polarity to the charge polarity of the toner by a power supply 7. A transfer paper P is conveyed between the photoreceptor drum PC and the transfer roller 6 by a conveyance roller pair 8, and the toner image on the photoreceptor drum PC is transferred onto the transfer paper P under the application of the aforementioned bias.

The transfer paper P on the surface of which the toner image is transferred is conveyed to a heat fusing unit provided with a fusing roller pair 11 and 12 which internally has a built-in heater, and made to pass between the fusing roller pair 11 and 12, by which the toner image carried on its surface is fixed.

From the surface of the photoreceptor drum PC after the toner image has been transferred onto the transfer paper P is removed foreign objects such as remaining toner and paper dust by a cleaning unit 9 provided with a cleaning blade, and thereafter, electric charges are removed by application of light from an electric discharger 10 to be subjected to the subsequent image forming process.

Figure 2:
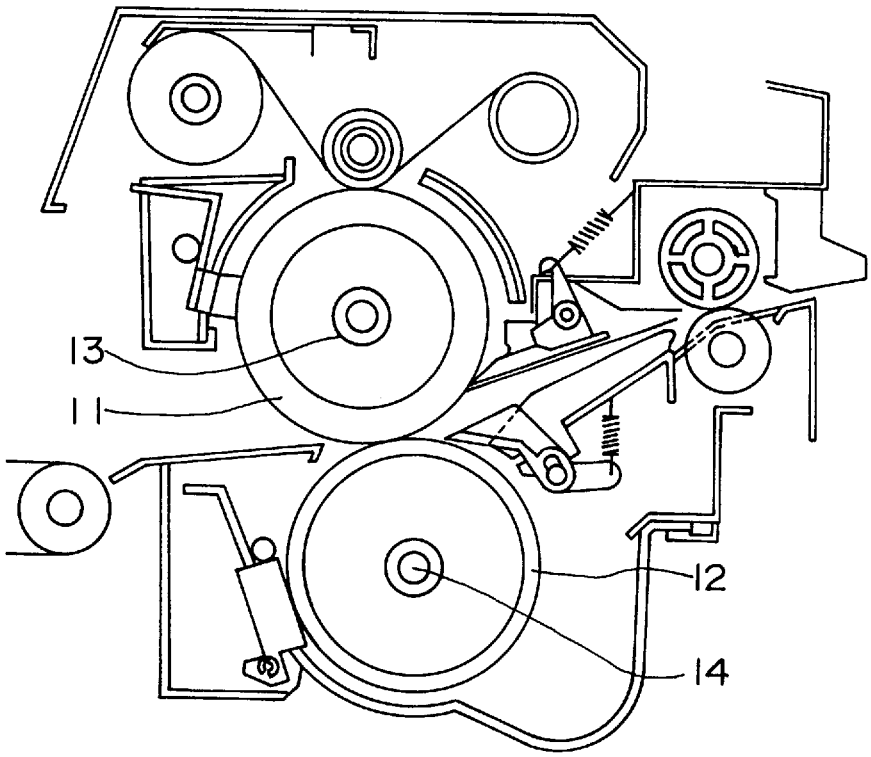
FIG. 2 is a sectional view of a heat fusing unit according to one embodiment of the present invention.
Figure 3:
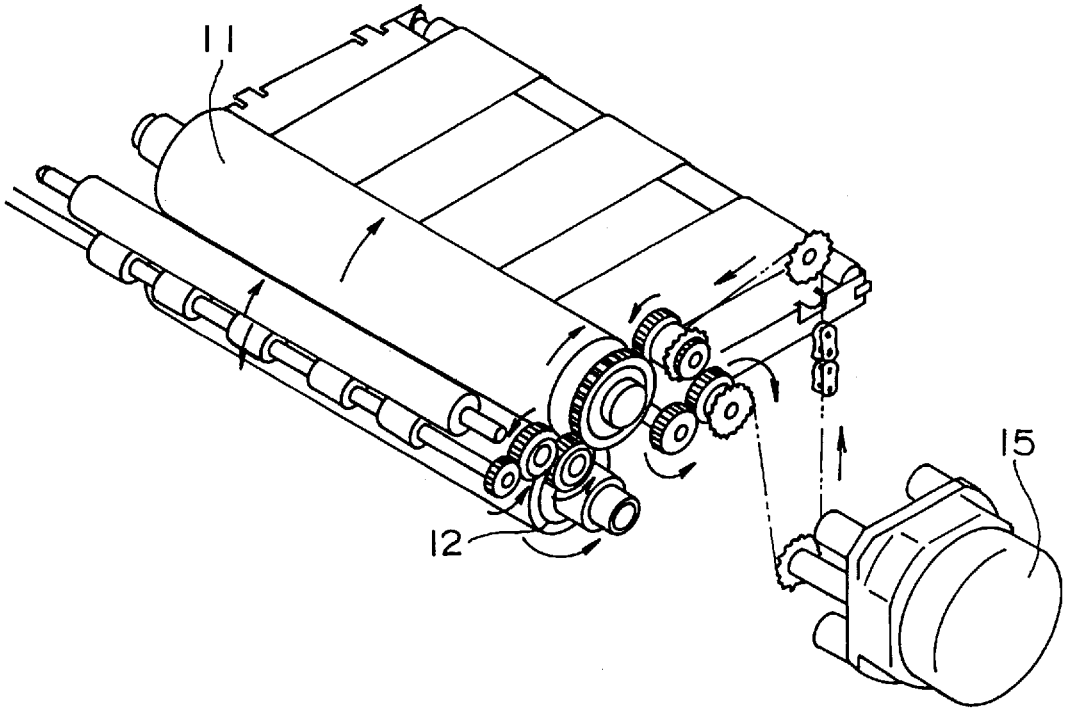
FIG. 3 is a perspective view showing a drive mechanism of the fusing unit shown in FIG. 2.

FIG. 2 is a sectional view of a heat fusing unit in one embodiment of the present invention, while FIG. 3 is a perspective view of a drive mechanism of the unit.

The heat fusing unit is provided with a pair of heating rollers 11 and 12, halogen lamps 13 and 14 provided at the center of the heating rollers and a motor 15 for rotatively driving the heating roller pair in a direction indicated by an arrow in FIG. 3.

The halogen lamps 13 and 14 are used as a heating source and operate to heat the heating roller pair 11 and 12 and the paper sheet nipped between the heating roller pair 11 and 12. The heating roller pair 11 and 12 are pressed against each other with a force of about 3 kg/cm$^2$. The heating roller 12, which is one of the heating roller pair, is a roller formed by coating a rubber elastic layer with a fluororesin layer.

In FIG. 2, an unfixed paper sheet that is conveyed from the left-hand side in FIG. 2 is nipped between the heating roller pair 11 and 12 and conveyed rightward in the figure while being heated by the halogen lamps 13 and 14.

Figure 4:
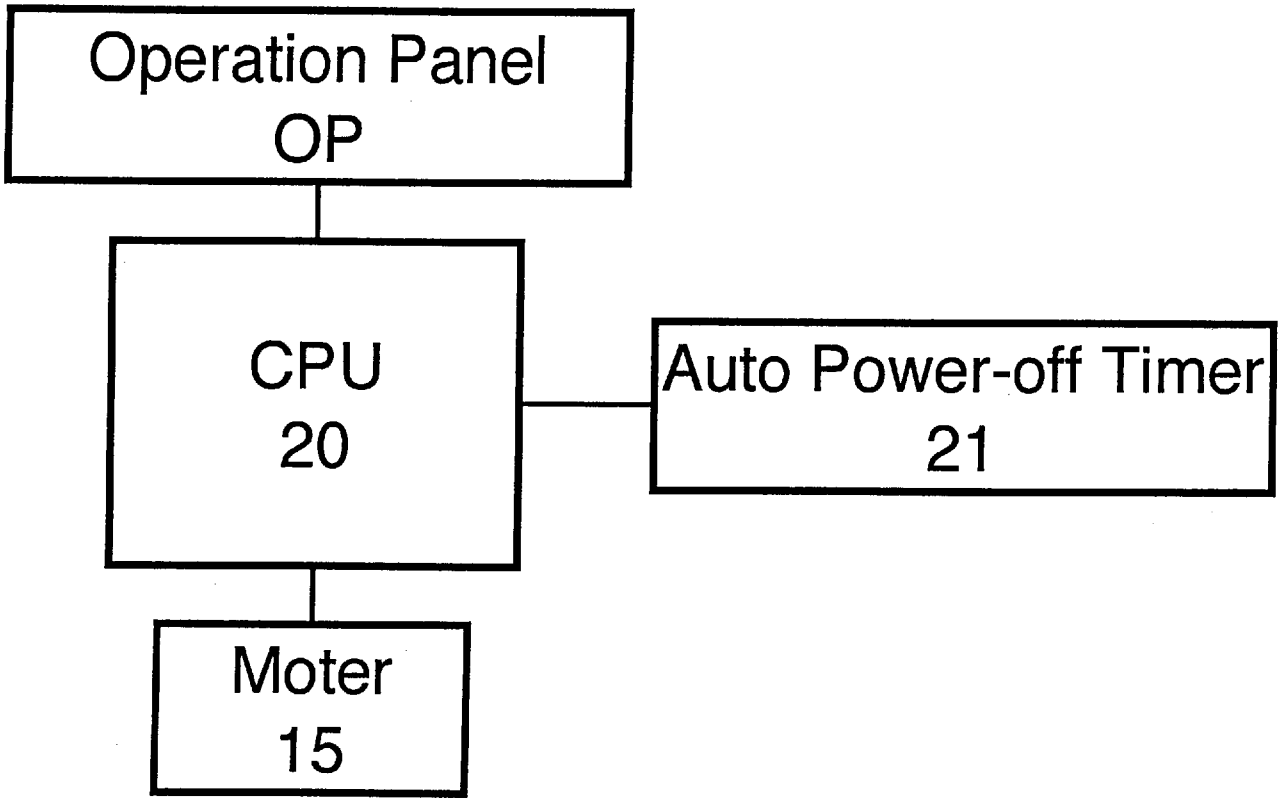
FIG. 4 is a control circuit diagram of the image forming apparatus of the present invention.

FIG. 4 shows a control circuit in the image forming apparatus of the present invention. A CPU 20 is a central processing unit for controlling the image forming apparatus. An operation panel OP is provided on the upper surface of the image forming apparatus for the setting of a variety of copying modes by the operator and the inputting with a copying start button and the like to be input to the CPU 20. By this operation panel OP, the operator can set a count time of an auto power-off timer described later and a time Δt for the rotation of various types of rollers before auto power-off. An auto power-off timer 21 is a timer for use in a control routine described later, and it starts when a copying operation is completed. The motor 15 is controlled by the CPU 20.

Figure 5:
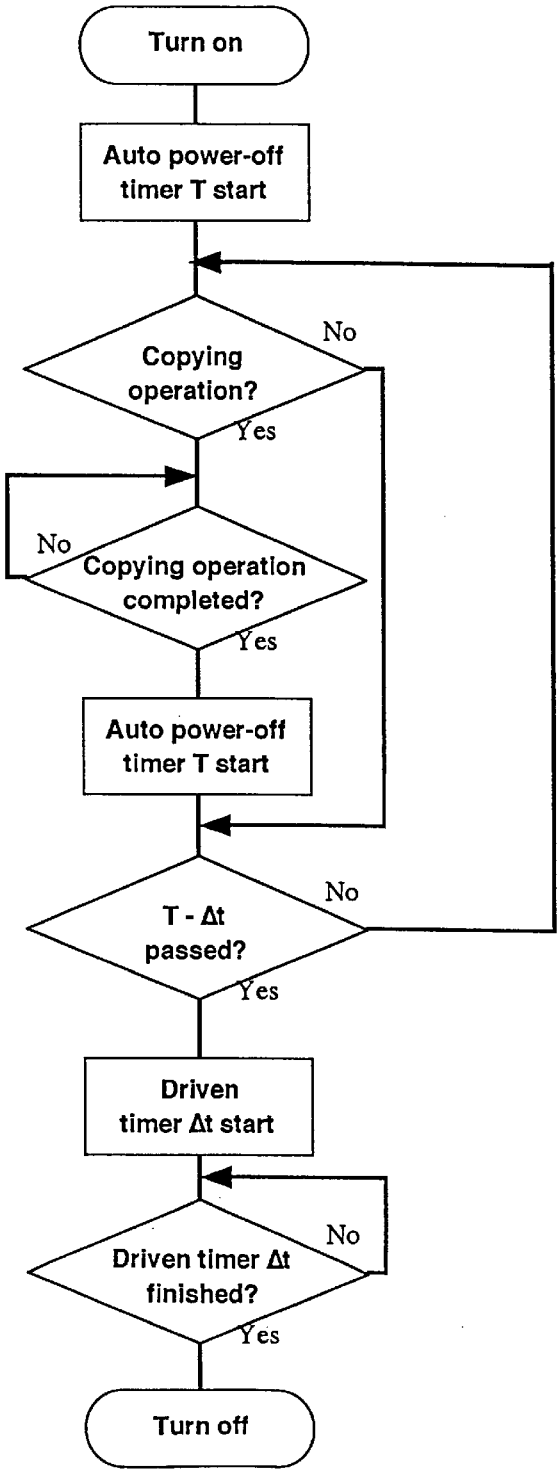
FIG. 5 is a flow chart showing a control routine of the fusing unit shown in FIG. 2 and FIG. 3.

FIG. 5 is a flow chart showing the control routine of the CPU 20.

When the power is turned on in Step S1, time counting is started from zero by the auto power-off timer 21 in Step S2. A time T in which the time counting of the auto power-off timer 21 is completed can be set again by a key input to the operation panel OP or the like by the operator.

It is determined in Step S3 whether or not the copying operation is being executed. When the answer is YES in Step S3, it is determined in Step S4 whether or not the copying operation has been completed. The process in Step S4 will be repeated until the answer becomes YES in Step S4. When the answer is YES in Step S4, the auto power-off timer is reset to zero in Step S5, and the operation restarts.

It is determined in Step S6 whether or not a time obtained by subtracting Δt second from the counting completion time T of the auto power-off timer has elapsed. The counting completion time T of the auto power-off timer and the time Δt can be arbitrarily set from the operation panel OP by the operator. The counting completion time T of the auto power-off timer has been preset to two hours, and the time Δt has been preset to about 0.1 second in the apparatus.

When the answer is YES in Step S6, a timer for driving the various types of rollers for a specified time is started in Step S7. The various types of rollers are driven to rotate for Δt second through the processes from Step S7.

It is determined in Step S8 whether or not the timer has completed the counting for Δt second, and the process in Step S8 will be repeated until the answer becomes YES.

When the answer is YES in Step S8, the power is automatically turned off in Step S9.

When the answer is NO in Step S3, it is determined that the apparatus is standing by for operation, and the processes from Step S6 are executed.

When the answer is NO in Step S6, the processes from Step S3 are executed.

In the above embodiment, the start of auto power-off becomes effective after the completion of the copying operation. However, the present invention is not limited to this, and the time may be a time effective after the operation of the operation panel OP by the operator or a combination of them.

The above has described in detail particularly the heat fusing unit. However, not limited to this, the present invention can be of course applied to the charging member and the transfer member. What is essential is to rotate the elastic roller for a specified time before the auto power-off.

As described above, the image forming apparatus of the present invention is provided with a heat fusing member including at least one roller having an elastic layer, a heating means for heating the heat fusing member, a drive control means for controlling the driving of the heat fusing member, an auto power-off means for executing auto power-off of the apparatus after counting a specified time and a rotating means for rotating the roller before the auto power-off is executed, based on the timing at which the auto power-off is executed. With this arrangement, the heating roller pair 11 and 12 is driven to rotate for Δt second immediately before the auto power-off set time T has elapsed from the completion of the last copying operation after turning-on of the power, and thereafter the power is turned off. By this operation, the rotational control of the heating roller pair is executed consistently within the auto power-off set time, thereby allowing the possible damage to the nip portion of the elastic roller to be reduced.

Furthermore, the image forming apparatus of the present invention is provided with a rotating means for rotating all the rollers having the elastic layer in the image forming apparatus before the auto power-off is executed. With this arrangement, possible damage to the nip portion of all the elastic rollers can be reduced.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising;

an auto power-off circuit for automatically turning off a power source of the apparatus at a predetermined timing, a roller, and a rotating section for rotating the roller before the auto power-off based on a timing at which the auto power-off is executed.

2. The image forming apparatus as claimed in claim 1, wherein said roller is the fusing roller.

3. The image forming apparatus as claimed in claim 2, further comprising a contact roller which is contact with said fusing roller.

4. The image forming apparatus as claimed in claim 3, wherein said fusing roller and contact roller are pressed against each other.

5. The image forming apparatus as claimed in claim 3, wherein at least one roller having an elastic layer.

6. The image forming apparatus as claimed in claim 2 further comprising a heater for heating said fusing roller.

7. The image forming apparatus as claimed in claim 1, wherein said roller is the charging roller.

8. The image forming apparatus as claimed in claim 1, wherein said roller is the transfer roller.

9. The image forming apparatus as claimed in claim 1, wherein said roller has an elastic layer.

10. The image forming apparatus as claimed in claim 1 further comprising a heater for heating said roller.

11. The image forming apparatus as claimed in claim 1 further comprising a power supply for applying a charging voltage to said roller.

12. The image forming apparatus as claimed in claim 1, wherein said auto power-off circuit automatically turns off the power source in response to completion of a rotation of the roller immediately after the completion of the rotation of the roller.

13. An image forming apparatus comprising;

a fusing means including at least one roller having an elastic layer, a heater for heating said fusing means, a driving means for rotating said roller, an auto power-off means for automatically turning off the power source of said apparatus at a predetermined timing, and a control means for controlling said driving means wherein said roller rotating the previous time before turning off said power source of said apparatus.

14. The image forming apparatus as claimed in claim 13, wherein said fusing means has roller pair.

15. The image forming apparatus as claimed in claim 14, wherein said roller pair are pressed against each other.

16. The image forming apparatus as claimed in claim 13, wherein said auto power-off means automatically turns off the power source in response to completion of a rotation of the roller immediately after the completion of the rotation of the roller.

17. A method of automatically turning off a power source of an image forming apparatus comprising the following steps of;

a first step for starting a timer when a copying operation is completed, a second step for rotating a roller before said timer is completed, and a third step for turning off said power source of said apparatus when said timer is completed.

18. A method of automatically turning off a power source of an image forming apparatus as claimed in claim 17, wherein said roller is the fusing roller.

19. A method of automatically turning off a power source of an image forming apparatus as claimed in claim 17, wherein said roller is the charging roller.

20. A method of automatically turning off a power source of an image forming apparatus as claimed in claim 17, wherein said roller is the transfer roller.

21. The method as claimed in claim 17, wherein said third step is executed in response to completion of the second step immediately after the completion of the second step.

22. An image forming apparatus comprising;

an automatic turn off means for automatically turning off the power source of the image forming apparatus at a predetermined timing, a driving means for rotating a roller, and a control means for controlling said driving means wherein said roller rotating the previous time before turning off said power source.

23. The image forming apparatus as claimed in claim 22, wherein said roller is a fusing roller.

24. The image forming apparatus as claimed in claim 23, further comprising a contact roller which is contact with said fusing roller.

25. The image forming apparatus as claimed in claim 24, wherein said fusing roller and contact roller are pressed against each other.

26. The image forming apparatus as claimed in claim 24, wherein at least one roller having an elastic layer.

27. The image forming apparatus as claimed in claim 23 further comprising a heater for heating said fusing roller.

28. The image forming apparatus as claimed in claim 22, wherein said roller is the charging roller.

29. The image forming apparatus as claimed in claim 22, wherein said roller is the transfer roller.

30. The image forming apparatus as claimed in claim 22, wherein said roller has an elastic layer.

31. The image forming apparatus as claimed in claim 22 further comprising a heater for heating said roller.

32. The image forming apparatus as claimed in claim 22 further comprising a power supply for applying a charging voltage to said roller.

33. The image forming apparatus as claimed in claim 22, wherein said control means energizes said automatic turn off means in response to completion of a rotation of the roller immediately after the completion of the rotation of the roller.

* * * * *